US007670238B2

(12) United States Patent
Esquerra

(10) Patent No.: US 7,670,238 B2
(45) Date of Patent: Mar. 2, 2010

(54) BALL HITTING TRAINING DEVICE

(76) Inventor: Robert Esquerra, 8775 Joeve Ct., San Diego, CA (US) 92119

( * ) Notice: Subject to any disclaimer, the term of this patent is extended or adjusted under 35 U.S.C. 154(b) by 0 days.

(21) Appl. No.: 11/689,766

(22) Filed: Mar. 22, 2007

(65) Prior Publication Data

US 2007/0232420 A1 Oct. 4, 2007

Related U.S. Application Data

(60) Provisional application No. 60/787,192, filed on Mar. 30, 2006.

(51) Int. Cl.
*A63B 69/00* (2006.01)

(52) U.S. Cl. ..... 473/457; 473/422; 473/437; 473/451

(58) Field of Classification Search ..... 473/422, 473/431, 437, 450, 451, 458, 464, 559, 564, 473/521, 457; 150/159, 160; D21/796
See application file for complete search history.

(56) References Cited

U.S. PATENT DOCUMENTS

| | | | | | |
|---|---|---|---|---|---|
| 2,633,173 | A * | 3/1953 | Reed | 150/160 |
| 2,737,394 | A * | 3/1956 | Abel | 473/256 |
| 2,747,636 | A * | 5/1956 | Couture | 150/160 |
| 3,603,368 | A * | 9/1971 | Brenner | 150/160 |
| 3,623,724 | A * | 11/1971 | Lande | 473/437 |
| 4,662,552 | A * | 5/1987 | Uyehara | 224/251 |
| D297,448 | S * | 8/1988 | Thawley et al. | D21/754 |
| 5,050,884 | A * | 9/1991 | Flory | 473/282 |
| 5,133,395 | A * | 7/1992 | Moore | 150/160 |
| 5,174,481 | A * | 12/1992 | LeDune | 224/602 |
| 5,213,324 | A * | 5/1993 | Bowers | 473/457 |
| 6,176,403 | B1 * | 1/2001 | Svare et al. | 224/251 |
| D514,648 | S * | 2/2006 | Sanders et al. | D21/796 |
| 7,278,539 | B2 * | 10/2007 | Souza | 206/315.1 |

* cited by examiner

*Primary Examiner*—Mitra Aryanpour
(74) *Attorney, Agent, or Firm*—Manuel F. de la Cerra

(57) ABSTRACT

A novel ball hitting training device configured to hold two bats together in a secure configuration. Also provided is a method of using the device to increase bat speed; strengthen the arm, core, and grip; and improve, and receive feedback on, bat swing technique. The training device allows the user to assess if his hands and grip are optimally positioned to deliver maximum power to the ball upon contact. The device provides two pockets, each having a bat handle end and a bat head end. The pockets are connected to each other between the bat handle ends and the bat head ends. Each bat handle end includes a bat handle opening, such that each pocket can receive a bat through the bat handle opening. A fastener near the bat handle end cinches the device around the bats, which may allow for the twisting of the bats such that the handles are touching and the knob of one bat is closer to the bat handle openings than the knob of the other bat. The device receives bats of various sizes and is constructed of a durable material, such as neoprene. It may also be advantageous that the fastener be a strap of double-sided hook and loop-type fastener material.

5 Claims, 4 Drawing Sheets

BALL HITTING TRAINING DEVICE

1. CLAIM OF PRIORITY

The present patent application claims priority as a continuation-in-part to U.S. provisional patent application Ser. No. 60/787,192 filed on Mar. 30, 2006 by inventor Robert Esquerra for DOUBLE BARREL BAT WRAP. The content of the provisional patent application is incorporated herein by reference.

2. FIELD OF THE INVENTION

The present invention relates generally to a training device to improve the speed, strength, and mechanics of a ball player's bat swing.

3. BACKGROUND OF THE INVENTION

Little Leaguers and professional ball players alike understand the value of a fast, powerful bat swing. At every level of competition, the athlete strives to improve the mechanics of his swing in order to increase bat speed and deliver more power to the ball. Once proper hitting technique is learned, the player may incorporate a weighted bat into practice and warm-up routines. A weighted bat requires greater exertion for the batter to swing. When the batter returns to swinging a regulation, non-weighted bat, he does so with the increased level of exertion, thereby increasing his bat speed.

The market currently offers several weights to improve bat speed in this manner. The most common bat weight takes the form of a donut or collar fit temporarily over the barrel of a standard bat. These devices have significant disadvantages, however. First, the donut weight transforms a perfectly-balanced bat into a top-heavy, unbalanced object. Particularly with young players, the unwieldy bat tends to overpower the batter, swinging him out of his normal hitting stance. A beginner who has not yet solidified his hitting mechanics can learn bad habits by swinging the unbalanced bat, and while a weighted bat may increase an experienced player's bat speed, its top-heavy quality can actually introduce improper techniques into his swing. For example, the weighted bat barrel tends to drop below the back shoulder, producing a long, sweeping swing.

Second, a bat outfitted with a donut weight cannot be used to hit a pitched ball. The weight is fitted over the bat's sweet spot—the part of the barrel designed to contact the ball and deliver optimal force to it. If the ball hits the donut weight instead of the bat barrel, the ball will ricochet off into an unpredictable direction. Unable to integrate swing practice with actual ball contact, the device is most often relegated to warm-up routines.

Third, the donut weight does not offer the batter any mechanism to assess his swing mechanics. Many, if not all, professional hitting instructors stress that at the point in the swing where contact is made with the ball, the palm of the batter's dominant hand, corresponding to the right hand if the batter is a right-handed hitter or the left hand if the batter is left-handed hitter, should face up towards the sky while the palm of the batter's non-dominant hand should face down toward the ground. This concept is known as the "palm up, palm down" configuration. To ensure the batter's hands are in this position upon contact with the ball, the batter's hands should be "palm up, palm down" when the bat enters the strike zone, or that part of the swing where it is possible to make contact with the ball.

Professional instructors advocate, and professional baseball players use, this specific hand configuration because it ensures the wrist of the dominant hand is straight, not bent, upon contact with the ball. A straight wrist in the dominant hand at the moment the bat contacts the ball produces the most powerful swing, as it ensures maximum power is transmitted from the batter's dominant arm through the bat and to the ball. Thus, the "palm up, palm down" concept is a critical feature of an effective, powerful swing. It is not intuitive, however, and requires practice, both for the beginning player to learn it correctly and for the more experienced player to perfect it in his swing.

A batter swinging a single bat can practice keeping the wrist of his dominant hand straight using the "palm up, palm down" concept. But the batter's focus on these details of swing mechanics is often lost as the batter concentrates on the required eye-hand coordination to hit an incoming ball. In addition, the batter cannot practice these techniques while swinging a bat fitted with a donut weight, as the unbalanced top-heavy bat interrupts the flow of the batter's normal swing and forces the batter to respond to the awkward forces created by the bat by bending his wrist. Thus, the donut weight does not reinforce proper hitting technique or allow the batter to assess if he is using proper hitting technique.

A second barrel-based device used to increase bat swing is a weighted sock that slips over the sweet spot of the bat. While this device yields a more balanced bat than the donut weight, it is not as perfectly balanced as that of an un-weighted bat. So again, the weighted sock can instill improper bat swing technique. The sock is also not intended to hit a moving ball and thus has limited utility as a warm-up device. Like the donut weight, the weighted sock can only serve the singular purpose of improving bat speed. While the player who swings a single bat equipped with a weighted sock may increase the speed of his swing, he has no way to gauge if the technique of that swing is correct. Without proper hitting mechanics, the player will not optimize the power he can transmit through his arms and deliver to the ball.

A final technique to improve bat speed has the player holding and swinging two bats together. While combining two optimally-balanced bats into one equally-balanced unit best mimics the weight and balance of swinging a single bat, it too suffers from many of the same disadvantages as barrel weights. For example, while it may be possible to hit a moving ball with the combination of bats, there is little preventing the bats from shifting during the swing and striking the ball at an awkward angle. Also the shifting of the bats may pinch the batter's fingers causing pain and discomfort. Equally dangerous are the bats themselves. With only the player's grip holding them together, the bats have a tendency to slip and slide against each other, resulting in the player having to readjust his grip or even to lose control of a bat during the swing. Finally, this technique does not offer any utility beyond warming up the player's muscles and improving bat speed, as the player is so focused on maintaining control over the cumbersome combination that he is incapable of evaluating the mechanics of his swing.

In sum, current ball hitting training devices disrupt the balance of the bat, cannot be used to hit moving balls, and do not enable the player to assess if his swing technique is correct. These deficiencies do not merely reduce the utility of the training devices, but can actually introduce or contribute to improper hitting technique.

4. SUMMARY OF THE INVENTION

The present patent application provides a novel ball hitting training device configured to hold two bats together in a secure configuration. A method of using the device is provided to increase the user's bat speed, strengthen his arm, core, and grip, and enable the user to improve, and receive immediate feedback on, his swing technique. Specifically, the device provides mechanisms to assess if the user's hands and grip are optimally positioned to deliver maximum power to the ball upon contact. The device provides two pockets that each have a bat handle end and a bat head end. The pockets are connected to each other between the bat handle ends and the bat head ends. Each bat handle end includes a bat handle opening, such that each pocket can receive a bat through the bat handle opening. A fastener near the bat handle end is also provided to cinch the device around the bats, which may allow for the twisting of the bats such that the handles are touching and the knob of one bat is closer to the bat handle openings than the knob of the other bat. The device receives bats of various sizes and is constructed of a durable material, such as neoprene. It may also be advantageous that the fastener be a strap of double-sided hook and loop-type fastener material.

5. BRIEF DESCRIPTION OF THE DRAWINGS

6. DETAILED DESCRIPTION

Figure 1:
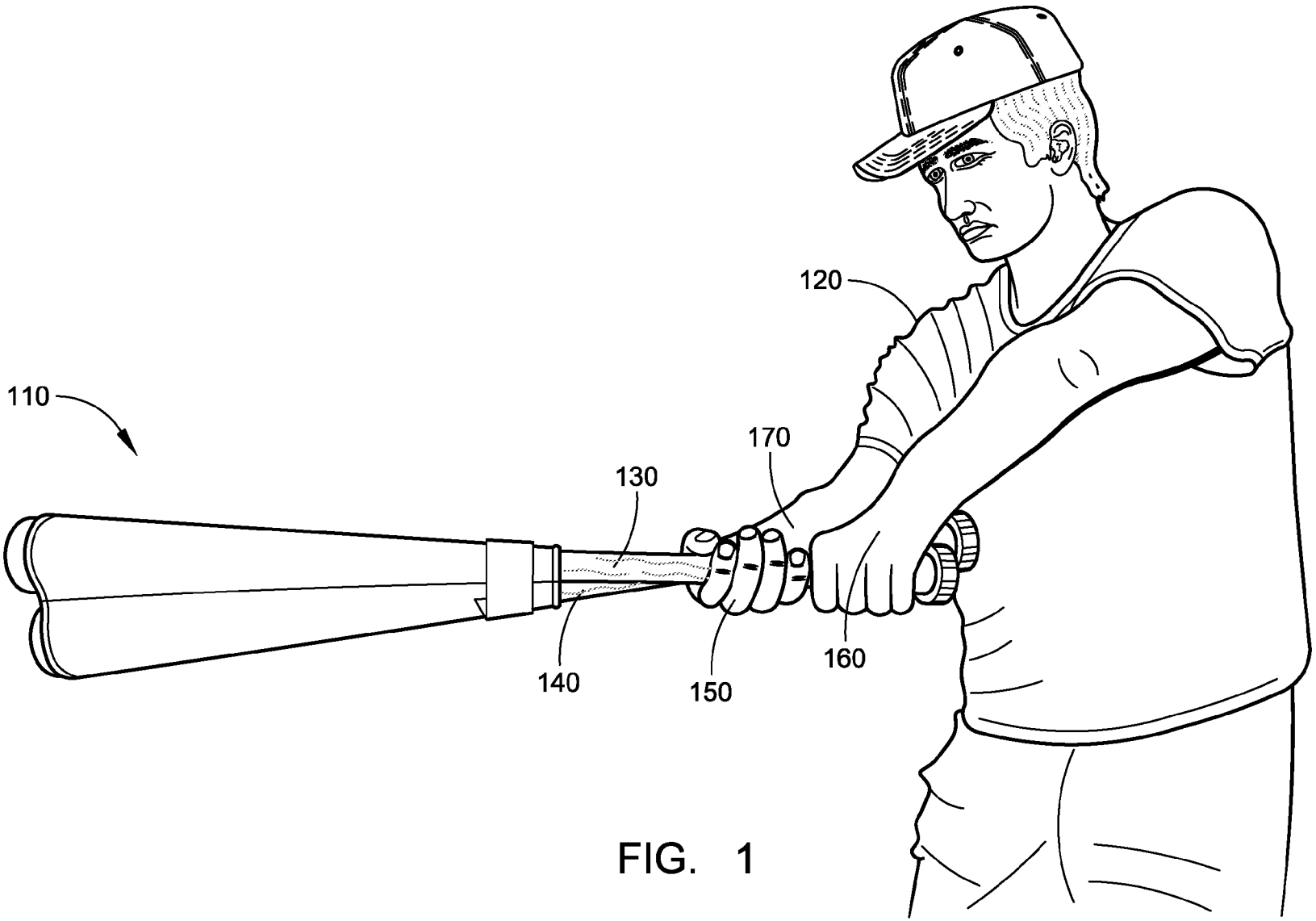
FIG. 1 illustrates a method of using the novel ball hitting training device, demonstrating proper alignment of one bat on top of a second bat.

To overcome the limitations of currently available bat speed training devices and methods, a ball hitting training device is provided for baseball and softball players at every level of competition. FIG. 1 illustrates a novel training device (110) being used to improve the bat speed and swing mechanics of a batter (120). The training device (110) is shown loaded with bats (130) and (140), which are together swung as an integrated unit by the batter (120).

The advantages of the novel ball hitting training device are many. First, it uses two bats that have been perfectly balanced by the manufacturer and does not disrupt that balance with barrel weights. In lieu of a barrel weight, a second bat provides the additional weight that is required for the training device to be heavier than a regulation bat. Thus, unlike the barrel weights provided by the prior art, the novel training device is evenly balanced throughout and more closely resembles the balance and feel of a single bat. The device is not top-heavy, so it will not lead the batter to develop the improper swinging techniques that characterize use of an unbalanced barrel-weighted bat. Throughout the swing, the batter experiences an increased weight, but the same balance, as he would swinging a single, non-weighted bat.

Second, the novel training device has the additional advantage of safely holding two bats together in a secure arrangement. Unlike the method of holding and swinging two loose bats together, the training device gives the batter control over both bats, ensuring the bats do not slide relative to each other and the bat handles do not shift in the batter's hands and pinch the batter's fingers. The user need not constantly readjust his grip on the bat handles to accommodate the shifting bats, nor is there a danger the batter will lose control of a bat during the swing.

A third advantage of the novel training device is that it can be used to hit a moving ball, unlike the prior art devices and methods. The device merely covers the bat barrel with material, allowing the batter to strike a pitched ball into a predictable trajectory. The device can be used to hit almost any type of ball that an unmodified bat is designed to hit, including, but not limited to, baseballs, softballs, tennis balls, and wiffle balls. Thus, the ball hitting training device can serve more than the single purpose of improving bat speed. Swinging the training device at a pitched ball allows the batter to practice his eye-hand coordination at the same time he works to perfect the mechanics of his swing.

The novel training device does more than solve the deficiencies of the prior art, however. When used correctly as illustrated in FIG. 1, the training device offers a unique method to learn and practice correct swing mechanics, providing immediate feedback to the batter on whether his technique is correct or incorrect. At the point in the swing where the bat would come into contact with the ball, the batter can immediately assess if his hands are in the "palm up, palm down" position. For example, the right-handed batter illustrated in FIG. 1 can see that his right hand palm (150) is facing up towards the sky while his left hand palm (160) is facing down towards the ground.

In addition to allowing the batter to assess his grip at this critical point in the swing, the training device provides a second and very useful mechanism to assess the batter's technique. When the training device is used correctly, the bats are positioned one on top of the other when they enter the strike zone. Specifically, bat (130) is positioned directly above bat (140). The barrels of both bats face the pitcher and are available for contact. If the batter's hands are not in the "palm up, palm down" position, the bats will not create this expanded hitting surface. Bats (130) and (140) are also parallel to the ground upon contact. If the wrist of the batter's dominant hand, here right wrist (170), is not straight upon contact, the barrels of bats (130) and (140) will be canted down toward the ground, as the batter's bent wrist is unable to hold them parallel to the ground.

It is important to quickly and accurately assess the batter's swing mechanics because the "palm up, palm down" technique is an integral element of a powerful and effective swing. The "palm up, palm down" configuration produces a straight wrist in the dominant hand at the moment the bat contacts the ball. A straight wrist in turn maximizes the power that is transmitted from the batter's dominant arm through the bat and to the ball at contact. The novel training device provides the batter with immediate feedback on his swing technique, as the batter can see if his palms are in the correct position, if the bats are aligned one on top of the other upon contact, if the wrist of his dominant hand is straight, and if the bats are parallel to the ground upon contact.

In addition to giving the batter the opportunity to assess multiple indicators of a proper swing on any one swing, repeated use of the novel training device reinforces the proper hitting technique until the batter automatically uses the "palm up, palm down" configuration in his swing. Practicing with the novel training device also provides the added benefit of strengthening the batter's wrists, arms, and core, in particular his dominant wrist and arm. Thus, the device is truly a training mechanism and not merely a warm-up tool. It strengthens the batter's grip and core while still allowing the batter to maintain proper swing mechanics and to receive immediate feedback on that swing upon contact with the ball. All of these advantages are in addition to that of increasing the batter's bat speed. The novel device is thus able to integrate seemingly disparate purposes into one easy-to-use training tool.

Figure 2:
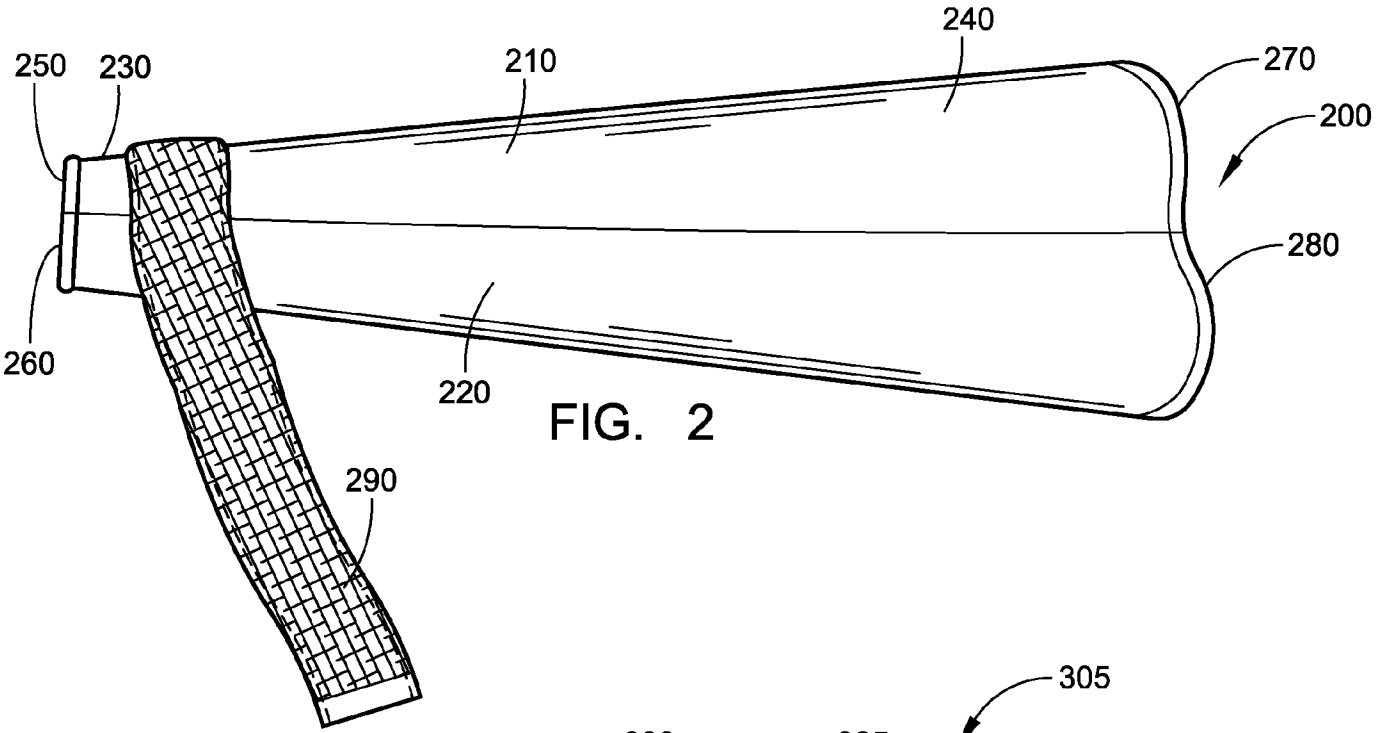
FIG. 2 is a perspective view of an embodiment of the novel ball hitting training device which includes bat head openings.

FIG. 2 illustrates a novel ball training device (200) that has openings at both ends of the device. The device (200) comprises two pockets (210) and (220) which are configured to hold bats. Pockets (210) and (220) each have a bat handle end and a bat head end. When the bats are loaded into the device, the bat handle end (230) is closest to the handles of the bats and the bat head end (230) is closest to the heads of the bats. Bats are loaded into pockets (210) and (220) through the bat head openings (270) and (280), which is discussed below with reference to FIG. 3.

Pockets (210) and (220) are connected along their lengths to form one integrated unit that can hold two bats. The method of joining pockets (210) and (220) may include, but is not limited to, attaching two separate pockets to each other along a line running from bat handle openings (250) and (260) to bat head openings (270) and (280). The method of attaching the pockets along this line may include, but is not limited to, stitching, radio frequency (RF) welding, or gluing them together. Alternatively, connected pockets (210) or (220) may be created by bisecting a single pocket to form two pockets. The method of bisecting the single pocket may include, but is not limited to, stitching, RF-welding, or gluing a seam down the length of a single pocket to create two pockets, each with a bat handle opening and a bat head opening.

Device (200) also comprises a fastener (290) that is attached to the device near the bat handle end (230). The fastener is used to cinch device (200) around two bat handles when bats are loaded into the device. The fastener may comprise, but is not limited to, one or more buttons, zippers, elastic bands, cinch ties, or straps constructed of double-sided hook and loop-type fastener material. Velcro® provides one example of a hook and loop-type fastener material.

Device (200) is constructed of any durable material that can withstand regular use. Such materials include, but are not limited to, natural fiber or synthetic cloth, leather, or plastic. Neoprene is one synthetic cloth that offers several benefits, in that it is durable, form-fitting, elastic, relatively inexpensive, easy to sew and adaptable to many shapes. Finally, the novel ball training device is dimensioned to accommodate bats of varying sizes, including, but not limited to, youth baseball bats that are twenty-four inches long and adult baseball and softball bats that are thirty-four inches long and longer. The device also accommodates wooden, metal, or composite bats.

Figure 3:
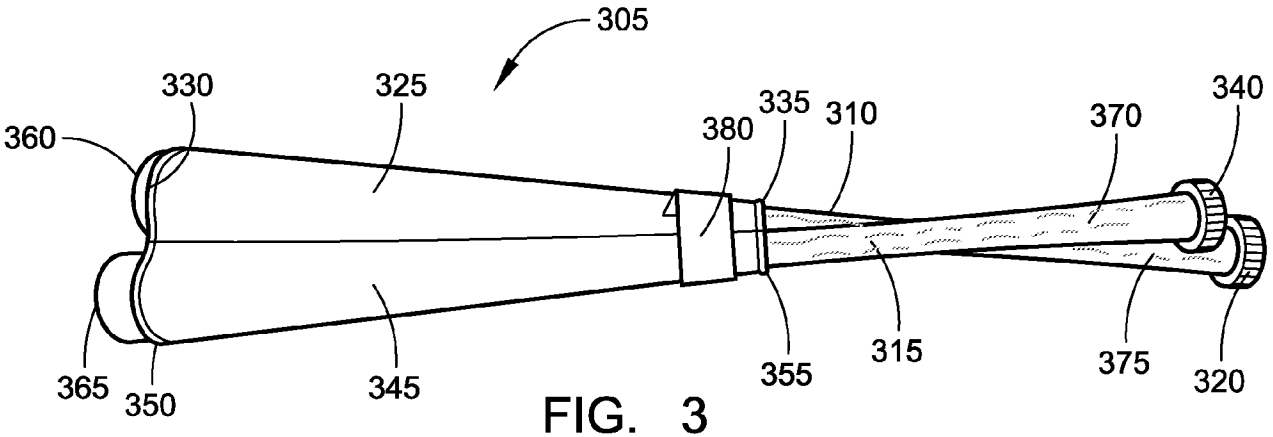
FIG. 3 is a perspective view of the novel ball hitting training device which includes bat head openings, shown loaded with bats.

Referring now to FIG. 3, a novel ball training device (305) with open bat head ends is shown loaded with bats (310) and (315) and ready for use as a training device. To set up the training device for use by a batter, knob (320) of bat (310) is fed through pocket (325), entering the device at bat head opening (330), sliding through pocket (325), and emerging at bat handle opening (335). Knob (340) of bat (315) is then fed through pocket (345), starting at bat head opening (350) and emerging at bat handle opening (355).

Next, bats (310) and (315) are twisted together, such that bat handle (370) is flush with bat handle (375) and knobs (320) and (340) are in contact with one another. In the embodiment shown in FIG. 3, the knobs are offset such that knob (320) is closer to the bat handle openings than knob (340). When bats (310) and (315) are properly twisted, the batter can grip bat handles (370) and (375) as one unit without difficulty. Finally, fastener (380) locks bats (310) and (315) in the twist position by cinching device (305) around bat handles (370) and (375). If the fastener comprises a strap, cinching is accomplished by wrapping strap (380) around device (305) and bat handles (370) and (375). Strap (380) is then held in place by a securing mechanism that can include, but is not limited to, buttons, elastic bands, or hook and loop-type fastener material. The novel ball training device is now ready for use by a batter to improve bat speed, eye-hand coordination, swing mechanics, and grip strength.

Figure 4:
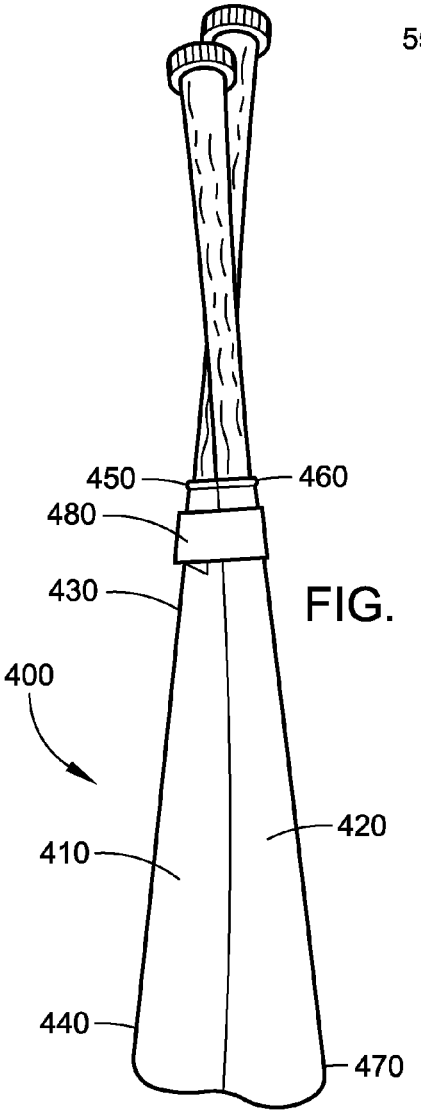
FIG. 4 is a perspective view of an embodiment of the novel ball hitting training device which includes closed bat head ends, shown loaded with bats.

FIG. 4 illustrates a novel ball training device (400) that has openings at only one end of the device. The device (400) comprises two pockets (410) and (420), each having a bat handle end and a bat head end. For example, pocket (410) has a bat handle end (430), closest to the bat handle, and a bat head end (440), closest to the bat head. Pockets (410) and (420) include bat handle openings (450) and (460), but do not have bat head openings. Instead, the bat head ends are closed. Closed bat head ends (440) and (470) are closest to the heads of two bats, protecting the bat heads from damage while device (400) is in use. To load bats into device (400), one bat is loaded into pocket (410) through bat handle opening (450), and pushed through the pocket until the bat head comes in contact with closed bat head end (440). A second bat is then loaded into pocket (420) through bat handle opening (460), and pushed through the pocket until the bat head touches closed bat head end (470). After the bats are twisted together, fastener (480) is secured to cinch device (400) around the twisted bats.

This embodiment of the novel training device requires bat handle openings (450) and (460) be dimensioned to accommodate the barrel of a bat during loading. Because the method of using device (400) as a training tool requires closed bat head ends (440) and (470) to be regularly placed on the ground, device (400) provides the added benefit of protecting the bat heads from dirt, scratches, or damage.

Figure 5:
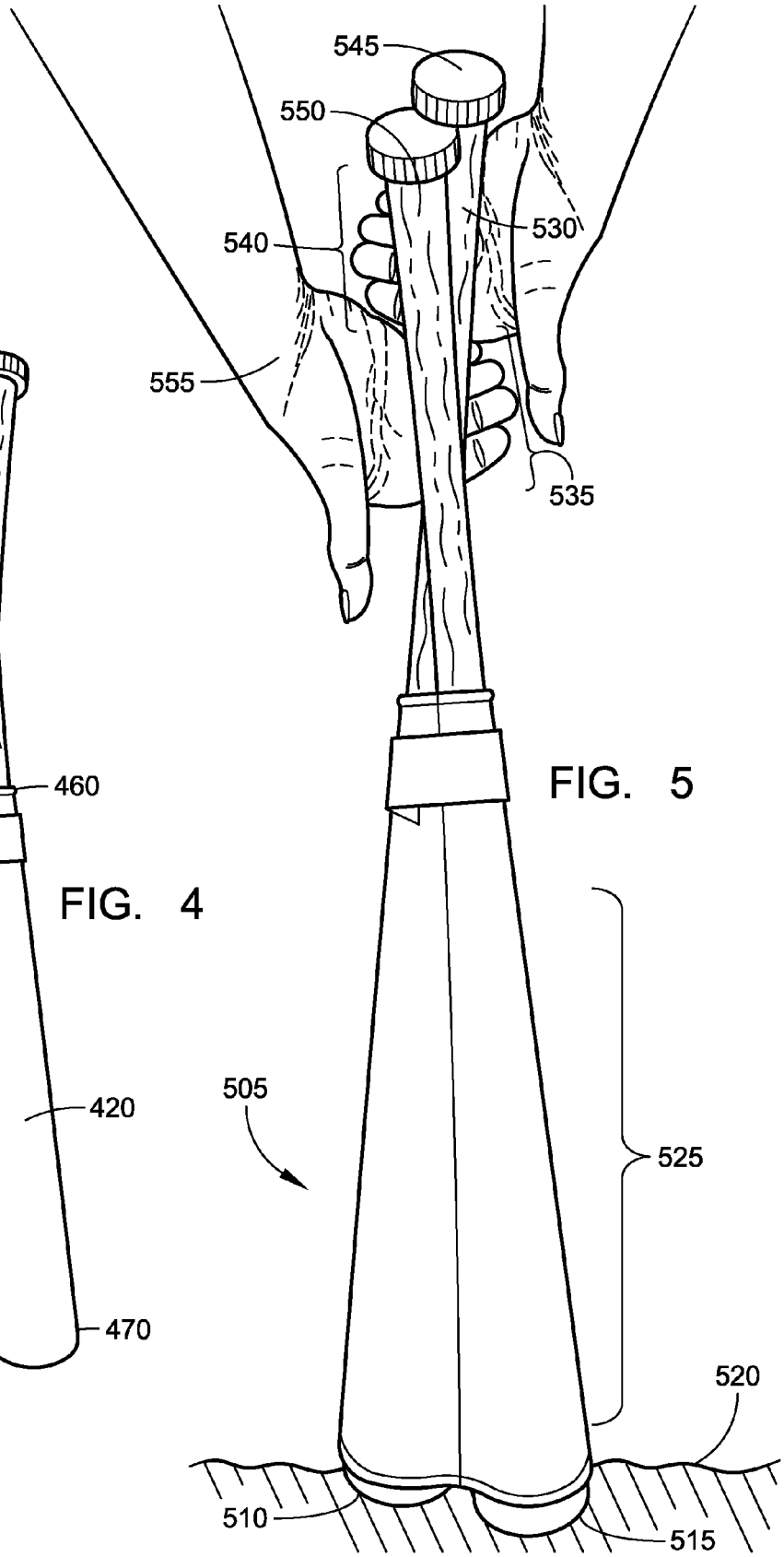
FIG. 5 illustrates a method of using the novel ball hitting training device, demonstrating the proper hand positions for a right-handed batter to grip the device.

Using the novel ball training device in a specific way ensures the batter will experience each of its advantages. In particular, the device must be gripped in a particular way to ensure the batter practices the "palm up, palm down" technique at the end of his swing. For the batter's hands to be in the "palm up, palm down" position with a straight wrist in the dominant hand at contact with the ball, FIG. 5 illustrates how the batter's hands should be positioned to grip the device. In the case of a right-handed batter, the right hand is considered the dominant hand and the left hand is the non-dominant hand, and vice versa for a left-handed batter. Thus, while FIG. 5 shows the proper hand placement for a right-handed batter to use training device (505), a left-handed batter simply uses his left hand, instead of his right hand, wherever the method calls for use of the batter's dominant hand.

To ensure the batter will end his swing in the "palm up, palm down" configuration, the batter completes the following steps. The batter places bat heads (510) and (515) on the ground (515) in front of him, in a stance similar to a golfer preparing to hit a golf ball on the ground in front of him. The combined hitting surface (525), which is twice the hitting surface of one bat, will be parallel to the user's chest. The batter places the bat handle closest to him, here bat handle (530), into the fingers of his dominant hand, here the right-hand fingers (535). The fingers of the non-dominant hand, here left-hand fingers (540), are then placed adjacent to right-hand fingers (535) on the section of bat handle (530) that is between the right-hand fingers (535) and knob (545). Next, the batter wraps his fingers and thumbs around bat handles (530) and (550) and grips them firmly. The batter then lifts the bats, encased in training device (505), into his hitting stance. When the batter swings at an imaginary or real ball, the hitting surface (525) will be available for contact and his hands will be in the "palm up, palm down" configuration as the bats enter the strike zone. The wrist of the batter's dominant hand, here right wrist (555), will be also be straight, allowing optimal power to be delivered through the right arm to the ball.

Figure 6:
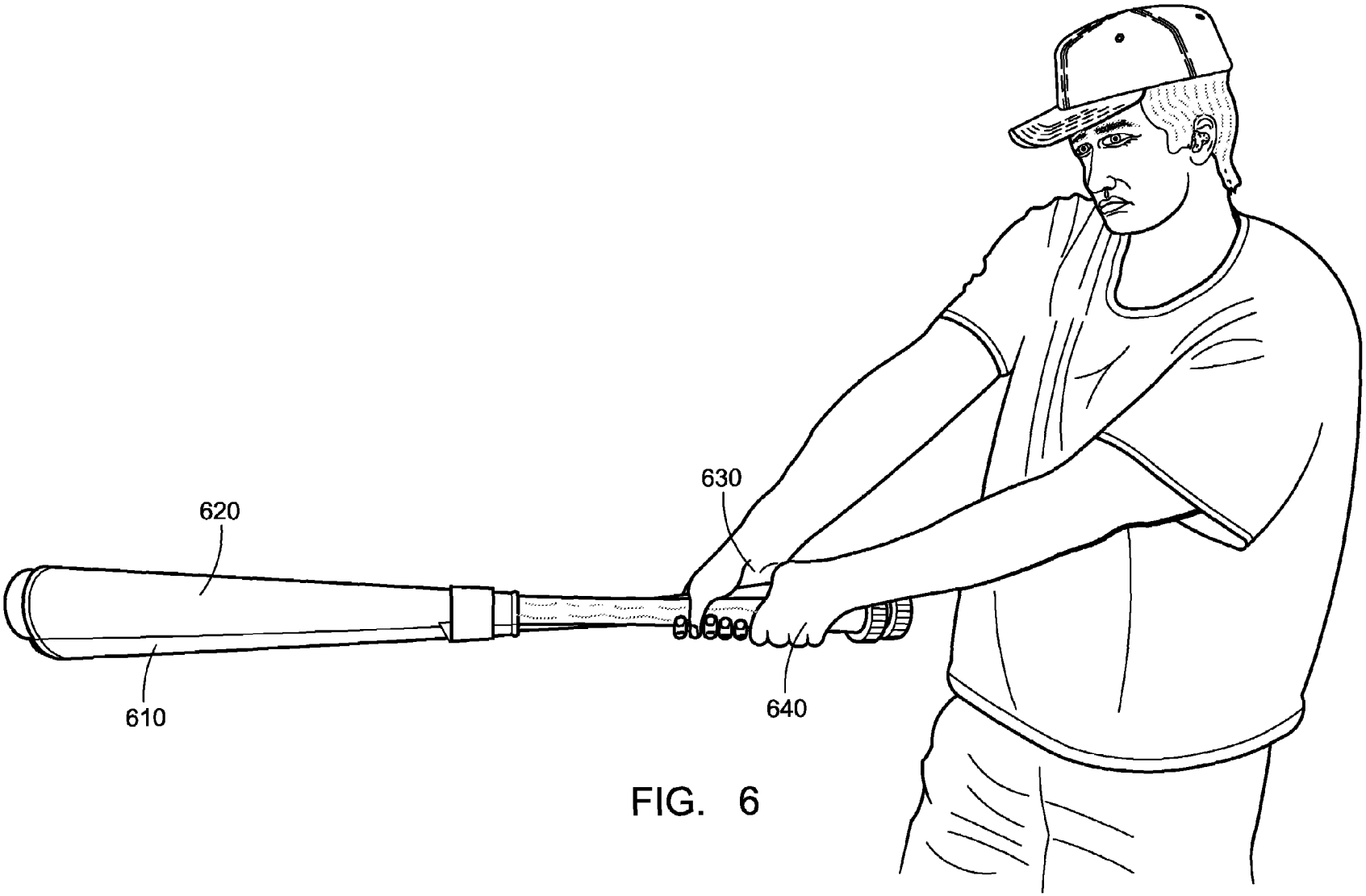
FIG. 6 illustrates a method of using the novel ball hitting training device, demonstrating improper alignment of one bat behind a second bat.

The novel training device gives the batter immediate feedback if he has picked up the bats with the wrong grip or is swinging the bats incorrectly. Referring now to FIG. 6, the batter can immediately see that at the point of contact, bat (610) is not on top of bat (620), and two bat surfaces are not available for contact. Instead, bat (610) is behind bat (620), presenting only the surface of bat (620) for contact. The batter can also see that his hands are not in the "palm up, palm down" position, such that the palm of his dominant hand, here the right hand, faces up to the sky and the palm of his non-dominant hand, here the left hand, faces down toward the ground. Instead, right hand palm (630) is perpendicular to the ground, facing the pitcher, and left hand palm (640) is also perpendicular to the ground, facing away from the pitcher. If the batter ends his swing in this position, or any other position other than bat (610) on top of bat (620) and hands in the "palm up, palm down" position, the batter knows to immediately stop and reevaluate his grip and hitting technique. The batter may have gripped the handles improperly during setup or he may have shifted his hands during the swing.

It is invaluable for the batter to immediately see he is using the improper technique illustrated in FIG. 6. Without the useful feedback imparted by the novel training device, the batter will continue to practice an incorrect swing, possibly to the point that it is ingrained in his regular hitting routine and very difficult to change. The incorrect technique affects the batter's hitting potential in many ways. If the batter's hands are not in the "palm up, palm down" position upon contact with the ball, he is likely to bend the wrist of his dominant hand instead of keeping it straight. A bent wrist cannot transmit the maximum power from the batter's hitting arm through the bat and to the ball, preventing the batter from capitalizing on his full hitting potential. Practicing the incorrect technique may also strengthen the batter's grip improperly, causing the wrong hand muscles to grow stronger and dominate the batter's grip during the swing. Once learned, an incorrect technique may be instinctive, making it very difficult for the batter to change his swing technique or strengthen his grip in the right areas. Thus, the novel training device allows the batter to increase the speed of his swing and strengthen his grip, arms, and core, without compromising the proper swing mechanics that are so critical to power hitting.

Having described the methods and structures in detail and by reference to several preferred embodiments thereof, it will be apparent that modifications and variations are possible without departing from the scope of the invention defined in the following claims. Moreover, the applicant expressly does not intend that the following claims "and the embodiments in the specification to be strictly coextensive." Phillips v. AHW Corp., 415 F.3d 1303, 1323 (Fed. Cir. 2005) (en banc).

The invention claimed is:

1. A method of using a ball hitting training device, comprising the steps of:

providing a ball hitting training device, the device comprising:

two pockets, wherein each pocket further comprises a bat handle opening and a bat head opening; and wherein each pocket is constructed to receive a bat through the bat head opening; and at least one fastener adapted to cinch the device around two bats, wherein the at least one fastener is attached to the device near the bat handle end;

loading a first bat into the device, wherein the first bat comprises a knob, a handle, and a head, by inserting the knob of the first bat into the bat head opening and feeding it through the pocket to the bat handle opening;

loading a second bat into the device, wherein the second bat comprises a knob, a handle, and a head, by inserting the knob of the second bat into the bat head opening of the unoccupied pocket and feeding it through the pocket to the bat handle opening;

twisting the first and second bats such that their respective handles and knobs touch and the knob of one bat is closer to the bat handle openings than the knob of the other bat;

cinching the fastener around the first and second bats;

placing the first and second bat head ends on the ground in front of the user such that the hitting surface is parallel to the user's chest;

placing the bat handle closest to the user into the dominant hand, such that the handle rests on the fingers of the dominant hand;

positioning the non-dominant hand on a section of the handle adjacent to that occupied by the dominant hand and located between the dominant hand and the knob, such that the handle rests on the fingers of the non-dominant hand;

gripping the bat handles of both bats firmly;

lifting the bats into a hitting stance;

swinging the bats, such that when the bats enter the strike zone, one bat is directly above the other bat.

2. The method of using a ball hitting training device of claim 1, wherein the swinging step further comprises swinging the bats such that when the bats enter the strike zone, the palm of the user's dominant hand faces up, the palm of the user's non-dominant hand faces down, and the wrist of the user's dominant hand is straight.

3. The method of using a ball hitting training device of claim 1, wherein the device is used to increase the speed of the bat during the swing.

4. The method of using a ball hitting training device of claim 1, wherein the device is used to strengthen the user's arm and core muscles and grip.

5. The method of using a ball hitting training device of claim 1, further comprising hitting a moving ball with the bat-loaded device.

* * * * *